United States Patent [19]

Langren

[11] 4,297,753

[45] Nov. 3, 1981

[54] PATIENT TRANSFER DEVICE

[75] Inventor: Robert J. Langren, Alameda, Calif.

[73] Assignee: Warner-Lambert Company, Morris Plains, N.J.

[21] Appl. No.: 73,416

[22] Filed: Sep. 7, 1979

[51] Int. Cl.[3] ..... A61G 7/08; A61G 12/00

[52] U.S. Cl. ..... 5/81 C; 198/632

[58] Field of Search ..... 5/81 C, 61, 81 R, 81 B, 5/82 B; 198/632

[56] References Cited

U.S. PATENT DOCUMENTS 2,590,359 3/1952 Zopf ..... 198/632

2,918,681 12/1959 Davis ..... 5/81 C 3,854,152 12/1974 Chez ..... 5/81 C

*Primary Examiner*—Roy D. Frazier

*Assistant Examiner*—Alexander Grosz

*Attorney, Agent, or Firm*—S. I. Miller; R. S. Strickler

[57] ABSTRACT

A patient transfer device having a frame which supports a number of parallel rollers over which an endless belt is fitted for travel across the rollers. The frame is rendered intermediately foldable for compactness of storage or carrying and particularly to facilitate initial installation and subsequent changing of belts for asepsis and/or wear replacement.

8 Claims, 5 Drawing Figures

PATIENT TRANSFER DEVICE

BACKGROUND OF THE INVENTION

1. Field of the Invention

Patient handling apparatus with particular reference to devices for assisting in the transfer of a patient from one surface of rest to another.

2. Discussion of the Prior Art

In transferring a patient from bed to stretcher or in similar situations, manual lifting has been relieved by the use of a rolling endless belt over which a patient, usually with bed sheet, may be pulled. The device disclosed in U.S. Pat. No. 2,918,681 is exemplary.

The endless belt being heretofore supported by rigid framework has been difficult to initially install and replace, particularly by one individual, and lacked a tightness necessary for optimum patient support and comfort. Additionally, the relative ungainliness of present endless belt transfer devices frequently renders storage and carrying troublesome.

In view of the foregoing, it is an object of the present invention to render endless belt patient transfer devices more readily adaptable to belt installation and replacement.

Another object is to provide for greater than usual storage, compactness and portability of the foregoing devices as well as opportunity for factory shipment without cover installed to avoid damage in transit, all with assurance of easy assembly at point of use.

Still another object is to make possible an unusual tightness of belt fitting for greater patient support and comfort.

Other objects and advantages of the invention will become apparent from the following description.

SUMMARY OF THE INVENTION

The foregoing objects and corollaries are accomplished with provision of a roller supporting frame having opposite end plates trussed in a predetermined spaced relationship with each other. A number of parallel rollers extending between the end plates and journaled therein are covered with an endless belt, e.g. a blanket of flexible rubberized fabric, canvas or another similar material.

Each end plate is comprised of a pair of arms (right and left) with reversal of detail, a middle plate and connecting screws. With the arms of each end plate aligned and the middle plate tightened there against with screws, the frame is set for use. For belt removal and replacement, loosening of the middle plate screws permits folding of the frame in half, i.e. into a U-shape, whereupon an initially tight fitting belt is loosened for removal and replacement. Reopening of the folded frame with a replacement belt initially loosely in place automatically tightens the belt to optimum snugness over the rollers.

Details of the invention will become more readily apparent from the following description when taken in conjunction with the accompanying drawings.

IN THE DRAWINGS

DESCRIPTION OF A PREFERRED EMBODIMENT

Figure 1:
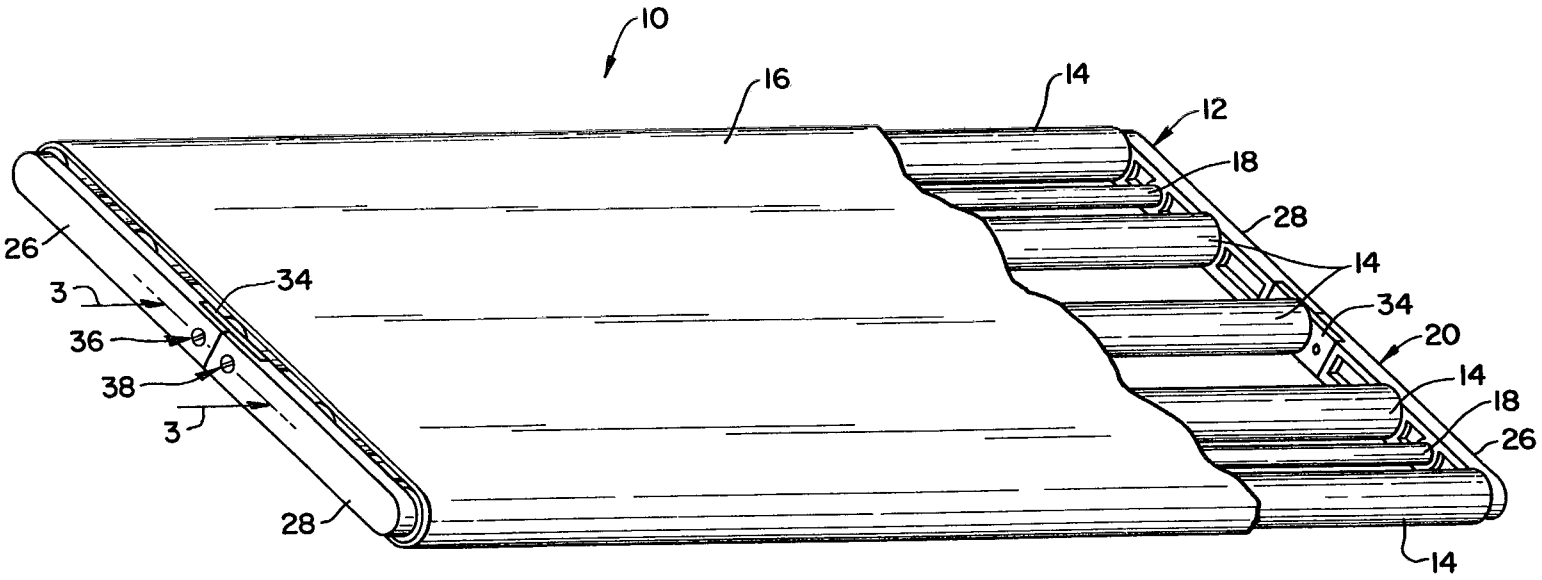
FIG. 1 is an illustration in perspective of a preferred embodiment of the invention.

Referring to the drawings, the illustrated patient transfer device 10 includes frame 12 which supports parallel rollers 14 over which endless belt 16 is tightly fitted. The frame is trussed with struts 18 and preferably constructed of aluminum or molded plastic and belt 16 is formed of canvas or a rubberized fabric. Other frame and belt materials may, of course, be used. Device 10, which may be of different lengths for pediatric or adult use, performs the function of easing transfer of a patient from one surface of rest to another in the manner described in the aforementioned U.S. Pat. No. 2,918,681.

Figure 5:
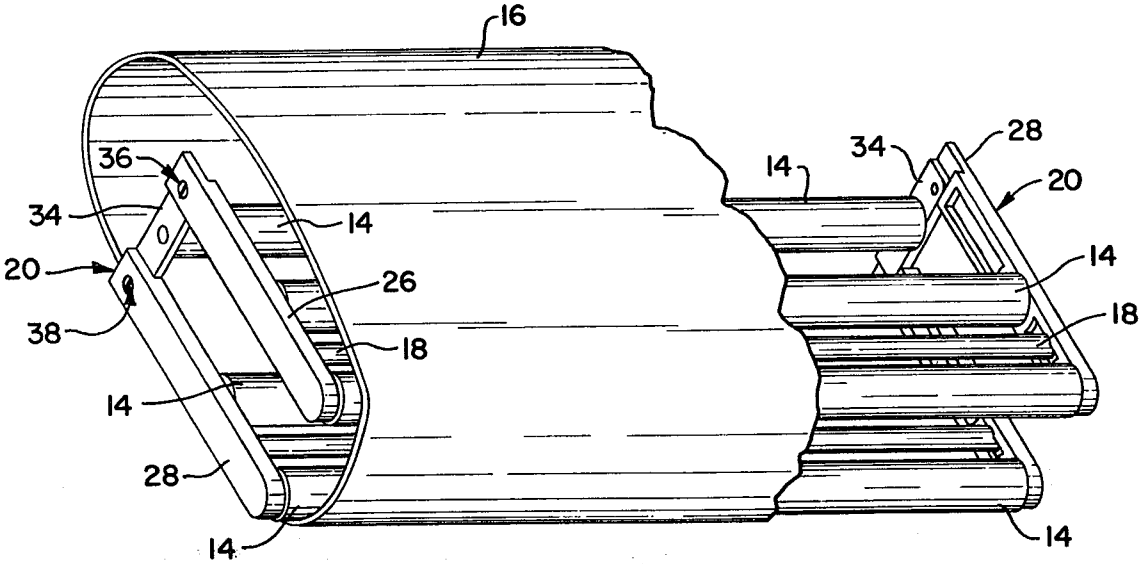
FIG. 5 is a view in perspective, of the patient transfer device with the frame thereof folded for removal or reception of an endless belt component.

According to the present invention, however, provision is made for folding frame 12 into the U-configuration of FIG. 5 to provide for compact storage, easier portability and particularly to facilitate removal and replacement of belt 16. In the latter respect, it should be apparent that folding of the frame loosens belt 16 for easier removal and replacement while opening of the frame to the fully extended condition of FIG. 1 effects automatic tightening of belt 16.

This manner of easy, on site belt tightening permits unusual snugging of belt 16 over rollers 14 for enhanced patient support and comfort. The effective belt circumference need only be controlled according to frame 12 size or vice-versa.

Figure 2:
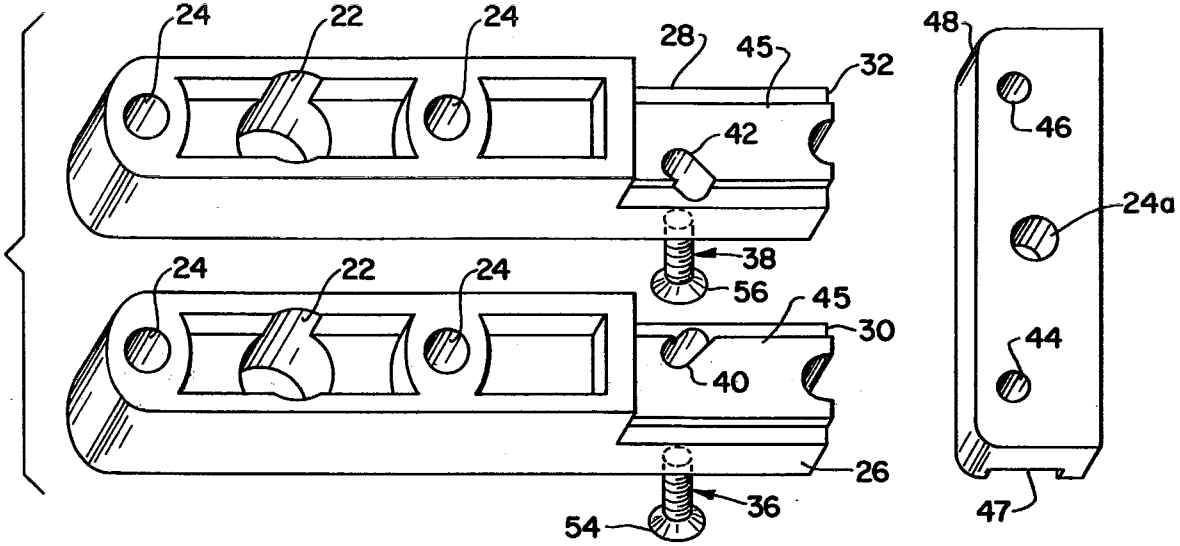
FIG. 2 is an exploded illustration of components of an end plate of the patient transfer device shown in FIG. 1.
Figure 3:
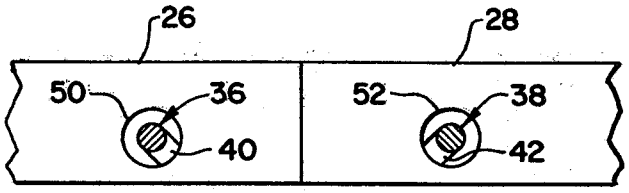
FIG. 3 is a fragmentary elevational view of the device of FIG. 1 with screwheads removed, the view being taken approximately at the position of line 3—3 and looking in the direction of the arrows.
Figure 4:
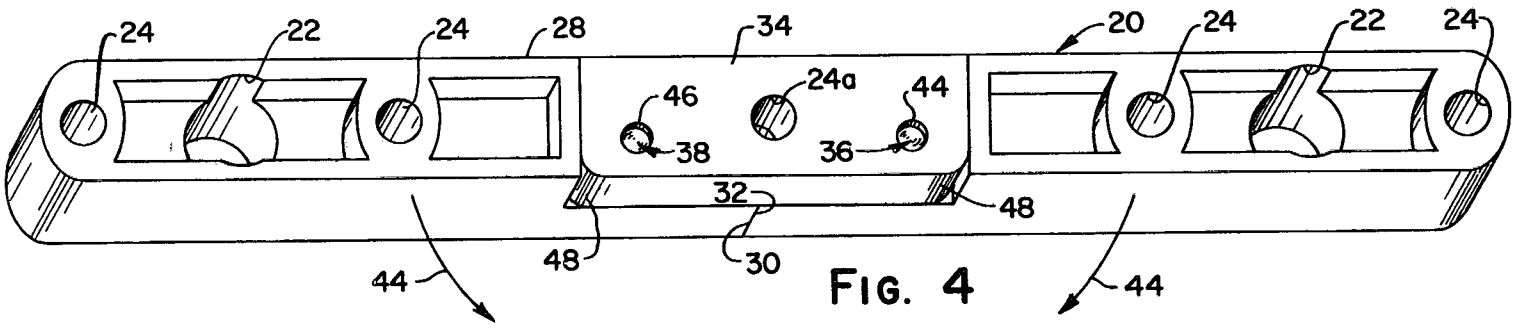
FIG. 4 illustrates the assembly of end plate components shown in FIGS. 2 and 3.

The present mechanism for folding frame 12 is best illustrated in FIGS. 2, 3, and 4 which depict component parts of one of end plates 20, the other end plate being similar.

For ease and clarity of illustration, the end plate shown in FIGS. 2 and 4 is without struts 18 which are normally secured in openings 22 and rollers 14 which are normally journaled in openings 24 and **24*a***.

End plate 20 (FIGS. 2–4) comprises arms 28 and 26 (right and left as viewed in FIG. 3) with reversal of detail. The adjoining ends 30 and 32 of arms 26 and 28 are recessed to receive middle plate 34. Plate 34 supports one end of one of rollers 14 (FIG. 5) in opening **24*a* and in turn, is connected to each of arms 26 and 28 by screws 36 and 38 extending through slots 40 and 42. Screws 36 and 38 having tapered heads are threaded into openings 44 and 46 in middle plate 34**.

With end plate 20 assembled as in FIGS. 1, 3, 4 and 5, a loosening of screws 36, 38 permits swinging of the arms one toward the other in the direction of arrows 44 (FIG. 4) for folding device 10 into the U-shaped configuration shown in FIG. 5.

Rounding of corners 48 of plate 34 and the longitudinal direction of slots 40, 42 allow the above folding of end plate 20 only in the direction of arrows 44. This prevents dropping of an extended end plate below the horizontal position of FIG. 1 even with screws 36 and 38 loosened.

When the right and left arms 26 and 28 are pushed into the aligned relationship shown in FIGS. 1, 3 and 4 (which can be accomplished in combination or one arm at a time), and screws 36, 38 are tightened, mating surfaces of plate 34 and arms 26, 28, are forced into a rigid locked position brought about by the geometry of these surfaces and paths of screw slots 40 and 42 (FIGS. 2 and 3). The mating surfaces of middle plate 34 and arms 26, 28 are respectively provided with an interlocking configuration. Channel 47 on the under side of middle plate 34 (FIG. 2) fits over raised portions 45 on adjoining ends of arms 26 and 28 when screws 36 and 38 are tightened. Additionally, slots 40 and 42 are provided with eccentric countersinks or cam followers 50 and 52, i.e. a countersink at one end of each as shown in FIG. 3, into which tapered heads or cam surfaces 54 and 56 of screws 36 and 38 are drawn with final tightening of screws 36 and 38. This forces arms 26 and 28 into a tightly aligned relationship with each other rendering the transfer device 10 secure and ready for use.

It is intended that the foregoing description and accompanying illustrations be exemplary of the invention and not delimiting of its scope. All modifications and changes apparent to those skilled in the art are considered to be within the scope of the invention.

I claim:

1. In a patient transfer device having a frame with trussed opposite end plates carrying a plurality of parallel rollers which support an endless belt very tightly, the improvement comprising:

means permitting selective folding of said end plates from a straight configuration, defining a tight belt condition, into a U-shaped configuration, defining a loose belt condition and cam means for releasably locking said plates in said straight configuration.

2. The improvement according to claim 1 wherein said end plates each comprise a pair of arms and a middle plate, said means for releasably locking said end plates including a pair of screws each formed with cam surfaces, one connecting each end of said middle plate to a one end of one of said arms.

3. The improvement according to claim 2 wherein said arms of each of said end plates are recessed to receive said middle plate.

4. The improvement according to claim 3 wherein mating surfaces of each recessed portion of each arm and the underside of said middle plate are provided with interlocking raised portions and channelling for locking said end plates in said straight configuration when said pair of screws are tightened.

5. The improvement according to claim 4 wherein the underside of said middle plate is channelled and recessed portions of said arms are provided with matching raised portions.

6. The improvement according to claim 3 wherein said arms are afforded slots through which said screws are extended toward said middle plate, there being threaded openings in said middle plate for receiving said screws.

7. The improvement according to claim 6 including an eccentric countersink in each of said slots.

8. The improvement according to claim 7 wherein said screws are provided with tapered heads and said tapered heads are drawn into said eccentric countersinks when said screws are tightened effective to cam said arms toward one another.

* * * * *